US006836903B1

(12) United States Patent
Goldstein

(10) Patent No.: US 6,836,903 B1
(45) Date of Patent: Jan. 4, 2005

(54) BRAIDED GARMENT AND METHOD OF MAKING

(76) Inventor: Mattea H. Goldstein, 1917 Lake La., Cherry Hill, NJ (US) 08003

( * ) Notice: Subject to any disclaimer, the term of this patent is extended or adjusted under 35 U.S.C. 154(b) by 0 days.

(21) Appl. No.: 10/719,862

(22) Filed: Nov. 21, 2003

(51) Int. Cl.[7] ..... A41B 9/00
(52) U.S. Cl. ..... 2/69
(58) Field of Search ..... 2/69, 115, 114, 2/105, 106, 113, 77, 243.1, 80, 81, 83, 85, 90, 108, 227, 228, 238; 66/1 A, 1 R, 1.5, 172 R, 180, 195, 171; 87/7, 13

(56) References Cited

U.S. PATENT DOCUMENTS 4,748,078 A * 5/1988 Doi et al. ..... 442/312
5,001,782 A * 3/1991 Stewart ..... 2/69
5,605,060 A * 2/1997 Osborne ..... 66/171

* cited by examiner

*Primary Examiner*—Gary L. Welch
(74) *Attorney, Agent, or Firm*—Stuart M. Goldstein

(57) ABSTRACT

A uniquely woven braid is fashioned on the outer surfaces of various garments, such as shirts, jeans, skirts or dresses. The braided surfaces provide a function, since they allow the garment to be form fitting and stretchably conform to the size and shape of the wearer. The braid also results in an attractive and decorative clothing design. The braid is accomplished easily and simply by cutting a plurality of slits in the outer surfaces of the garment and threading the adjacent resulting loop segments which ultimately form the braid.

10 Claims, 5 Drawing Sheets

BRAIDED GARMENT AND METHOD OF MAKING

BACKGROUND OF THEE INVENTION

The clothing industry has created a variety of different woven or braided designs which have been used for ornamental purposes; and, in some instances, the designs have served utilitarian purposes. For example, U.S. Des. Pat. No. 337,194 discloses convertible trousers which have decorative woven sides and which can shortened by lacing. U.S. Des. Pat. No. 396,339 shows a shirt type garment with sections laced together, resulting in a decorative pattern. U.S. Des. Pat. No. 414,912 shows a lace-up jeans' design which also serves to secure the jeans.

SUMMARY OF THE INVENTION

It is thus the object of the present invention to provide a braided garment which presents additional alternatives to enhance the design and function of woven, laced, or braided clothing.

It is an object of the present invention to provide a unique and attractive decorative design for clothing which also serves a functional purpose.

It is another object of the present invention to provide a braided garment which results in form fitting clothing, to stretchably conform to the size and shape of the wearer.

It is still another object of the present invention to provide a braided garment which can easily and quickly be braided.

It is a further object of the present invention to provide a method of braiding the garment which is simple and fun and which can be used on a variety of different types of clothing.

These and other objects are accomplished by the present invention, garments, such as shirts, jeans, skirts or dresses, which have uniquely braided outer surfaces. The braided surfaces provide a function, since they allow the garment to be form fitting and stretchably conform to the size and shape of the wearer. The braid also results in an attractive and decorative clothing design. The braid is accomplished easily and simply by cutting a plurality of slits in the outer surfaces of the garment and threading the adjacent resulting loop segments which ultimately form the braid.

Novel features which are considered as characteristic of the invention are set forth in particular in the attendant claims. The invention itself, however, both as to its design, construction and use together with the additional features and advantages thereof, are best understood upon the review of the following detailed description with reference in the accompanying drawings.

DETAILED DESCRIPTION OF THE INVENTION

Figure 1:
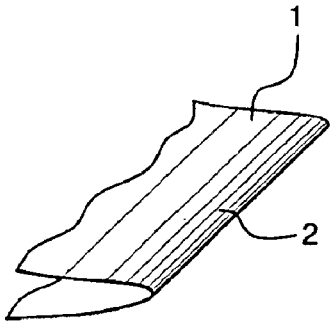
FIG. 1 shows a typical outer surface of a garment to be braided in accordance with the present invention.
Figure 2:
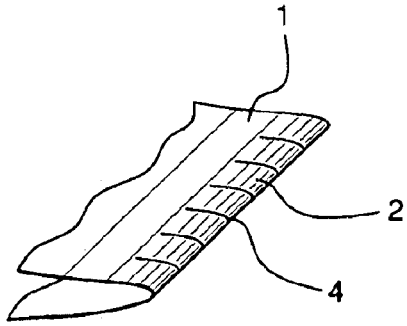
FIG. 2 shows the outer surface in FIG. 1 with slits cut into the material of the garment.
Figure 3:
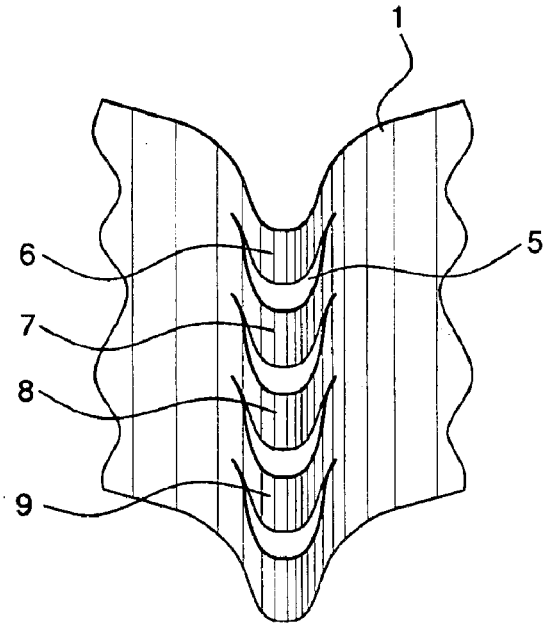
FIG. 3 shows an elevation view of the outer surface of the clothing to be braided in accordance with the present invention.

FIGS. 1–5 show the method of braiding a garment, which is a subject of the present invention. FIG. 1 shows section 1 of an article of clothing which, optimally, is of material which is somewhat stretchable in nature, e.g. cotton material such as is used in a polo shirt, jeans material or the like. Section 1 is a representative outer section of the shirt, jeans, lightweight jacket, skirt, or other article of clothing which is contemplated by the present invention. Section 1 has outer surface 2. In accordance with the method of the present invention, a plurality of slits 4 are cut into outer surface 2 of section 1. Slits 4 form a series of aligned openings 5 when section 1 is expanded, as shown in FIG. 3. Alternatingly formed between slit openings 5 is a plurality of aligned loop segments 6, 7, 8, and 9, also shown in FIG. 3. For purposes of the herein description of the present invention, four looped segments are shown; however, the invention is not to be considered restricted by the number of looped segments and the length of the ultimate braid which is formed within an article of clothing. There are no restrictions on the number of slits which can be cut into the outer surface of the garment to be braided and hence the number of looped segments and ultimate length of the braid.

Figure 4:
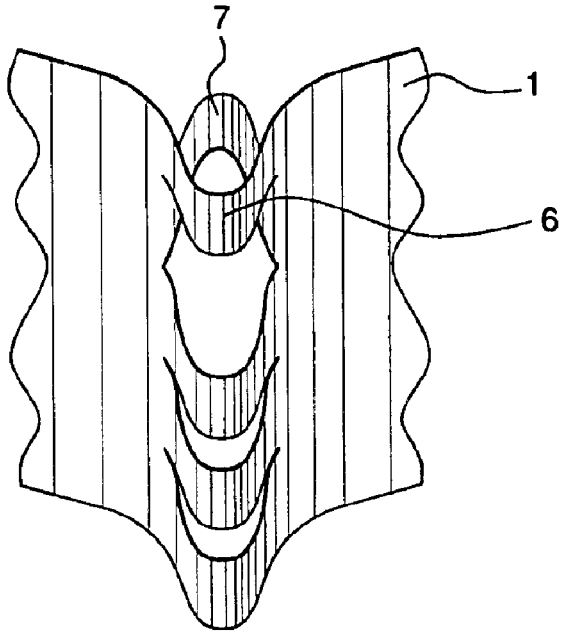
FIG. 4 shows the initial braiding step of the method of the present invention.
Figure 5:
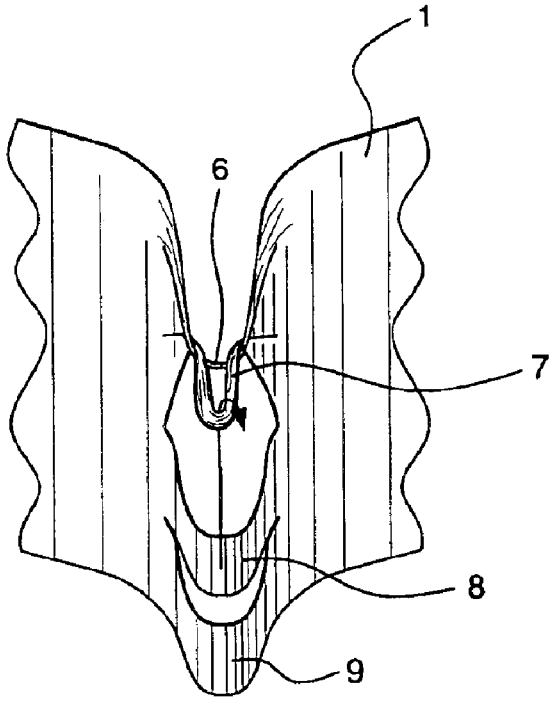
FIG. 5 shows the subsequent braiding step of the method of the present invention.
Figure 6:
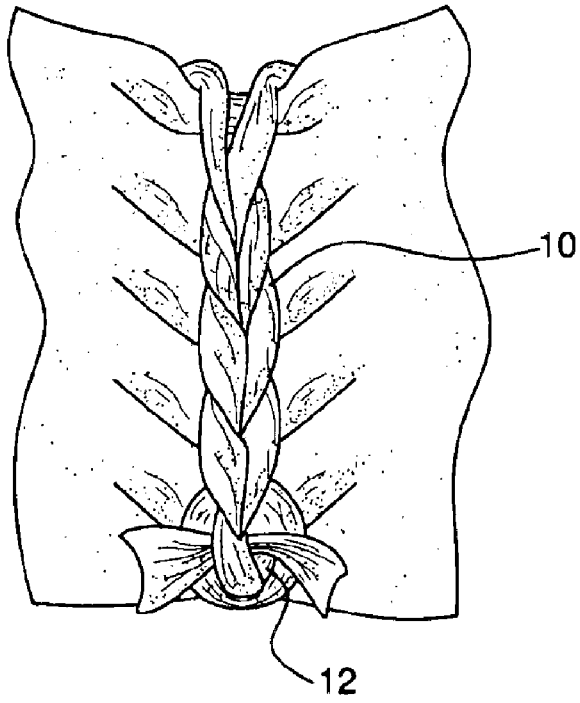
FIG. 6 shows the final braid design of the present invention.

FIG. 4 shows the initial step in the braiding operation. Loop segment 7, which is the second looped segment in the row of aligned looped segments, is pulled under loop segment 6, the first loop segment in the alignment. Loop segment 7 is then pulled over loop segment 6, as shown in FIG. 5. Loop segment 8 is then pulled tight through loop segment 7, also as shown in FIG. 5. This procedure is repeated with the next loop segment in the row; that is loop segment 9, the fourth loop segment in the plurality of aligned loop segments, is pulled through loop segment 8. Each loop segment is pulled tight in relation to its previous loop segment. Subsequent loop segments in the row of aligned loop segments are similarly pulled through each of their respective preceding loop segments in the row. The resulting braid 10 shown in FIG. 6 is secured from unraveling by tying a standard knot 12 using the last loop segment at the end of the braided row. The same braiding procedure can then be followed on the opposite side surface of the garment.

Figure 7:
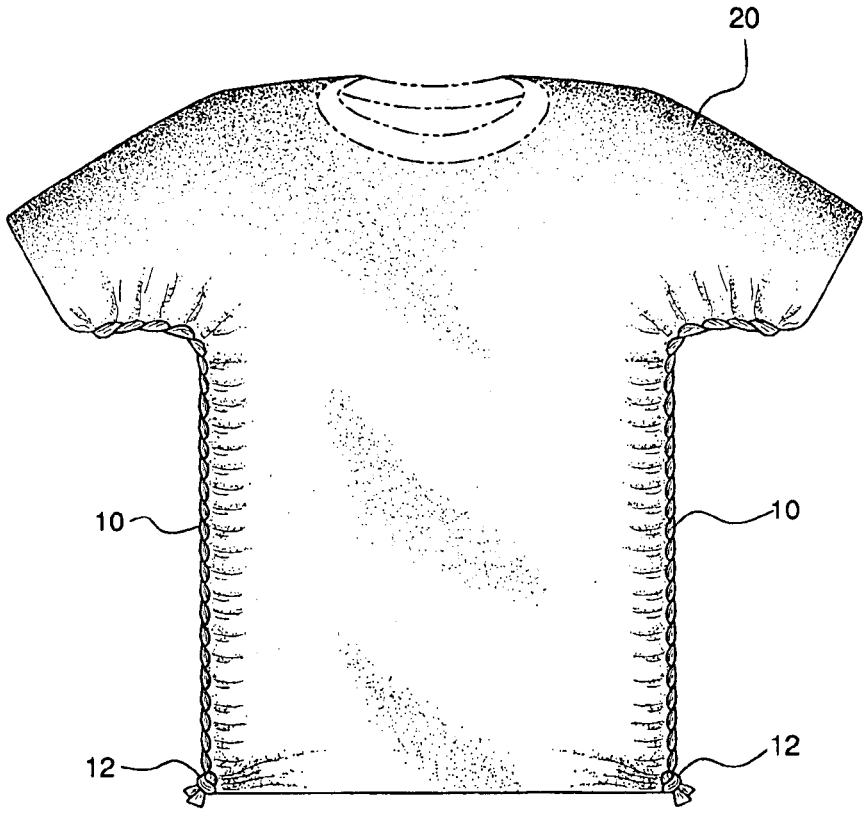
FIG. 7 shows an example of the garment of the present invention employing the braid of the present invention.
Figure 8:
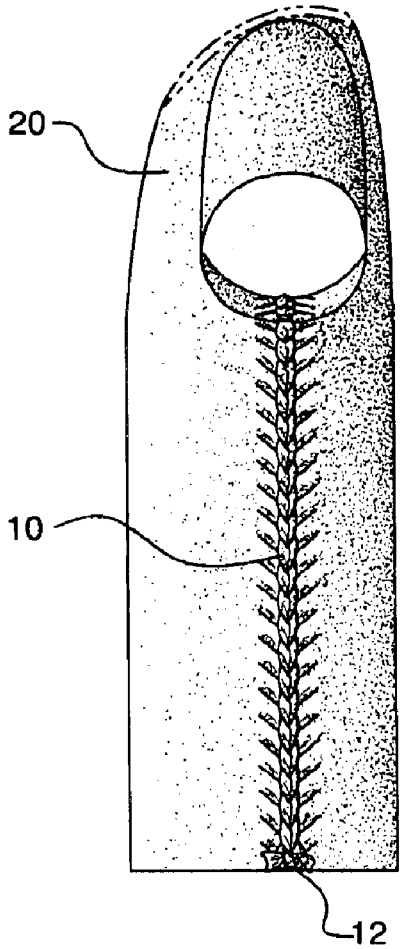
FIG. 8 shows a side view of the garment in FIG. 7.

FIGS. 7 and 8 show shirt 20 employing braid 10 of the present invention. Braid 10 is located on both outer side surfaces of shirt 20. While braid 10 is shown on the outer side surfaces of shirt 20, the braid of the present invention can be woven into any article of clothing, e.g. jeans, shorts, lightweight jackets and other types of shirts and blouses, which has an outer side surface or any foldable outer surface which would permit the cutting of aligned slits 4.

The braid of the present invention provides an attractive and decorative design to enhance the look of a standard piece of clothing. When woven within clothing which is of stretchable material, the braid also serves a functional purpose, since the resulting garment is form fitting to the wearer, the braid providing expansion or contraction of the clothing, given the size and shape of the wearer.

Certain novel features and components are disclosed in detail in order to make the invention clear in at least form thereof. However, it is to be clearly understood that the invention as disclosed is not necessarily limited to the exact form and details as disclosed since it is apparent that various modifications and changes may be made without departing from the spirit of the invention.

What is claimed is:

1. The method of braiding an article of clothing comprising the steps of:

providing an article of clothing with outer surfaces;

cutting a plurality of slits in one of the outer surfaces so as to form a row of adjacently aligned braidable segments between the slits;

pulling the second segment in the row of segments underneath the adjacent first segment in the row;

pulling the second segment in the row over the adjacent first segment, so that the second segment forms a first loop;

pulling the third segment in the row substantially through the first loop of the second segment so that the third segment forms a second loop;

pulling the fourth segment in the row substantially through the second loop of the third segment so that the fourth segment forms a third loop;

sequentially pulling each subsequent segment in the row substantially through the loop formed by its respective preceding segment in the row, forming a braid along the outer surface;

securing the last segment in the row to maintain the segments on the outer surface in the braid which is formed.

2. The method as in claim 1 comprising the further steps of;

cutting a plurality of slits in a second outer surface of the article of clothing so as to form a second row of adjacently aligned braidable segments between the slits;

pulling the second segment in the second row of segments underneath the adjacent first segment in the row:

pulling the second segment in the second row over the adjacent first segment, so that the second segment forms a first loop;

pulling the third segment in the second row substantially through the first loop of the second segment so that the third segment forms a second loop;

pulling the fourth segment in the second row substantially through the second loop of the third segment so that the fourth segment forms a third loop;

sequentially pulling each subsequent segment in the second row substantially through the loop formed by its respective preceding segment in the row, forming a braid along the second outer surface;

securing the last segment in the second row to maintain the segments on the second outer surface in the braid which is formed.

3. The method as in claim 1 wherein the article of clothing comprises a stretchable material.

4. An article of clothing with outer surfaces, said article of clothing comprising a first row of a plurality of aligned, unitary looped segments each segment being separately and individually formed from and emanating from an outer surface of the clothing, each constituting a separate and independent segment, the row extending along an outer surface of the clothing, the second looped segment in the row being positioned substantially over the adjacent first segment in the row, the third looped segment in the row being positioned substantially through and over the second looped segment, the fourth looped segment in the row being positioned substantially through and over the third looped segment, and each of the following looped segments in the plurality of aligned looped segments being positioned substantially through and over each of its respective proceeding looped segment in the row, the plurality of looped segments forming a braid alone an outer surface.

5. The article of clothing as in claim 4 further comprising means to secure the last looped segment in the row to maintain the plurality of aligned looped segments along the outer surface of the clothing.

6. The article of clothing as in claim 4 further comprising a second row of a plurality of aligned looped segments formed from the clothing and extending along a second outer surface of the clothing, the second looped segment in the second row being positioned substantially over the adjacent first segment in the row, the third looped segment in the second row being positioned substantially through and over the second looped segment, the fourth looped segment in the second row being positioned substantially through and over the third looped segment, and each of the following looped segments in the plurality of aligned looped segments being positioned substantially through and over each of its respective proceeding looped segment in the second row.

7. The article of clothing as in claim 6 further comprising means to secure the last looped segment in the second row to maintain the plurality of looped segments along the second outer surface of the clothing.

8. The article of clothing as in claim 4 wherein the article of clothing is a shirt.

9. The article of clothing as in claim 6 wherein the article of clothing is a shirt with two outer surfaces, one outer surface comprising the first row of a plurality of aligned looped segments and the second outer surface comprising the second row of a plurality of aligned looped segments.

10. The article of clothing as in claim 4 wherein the clothing comprises a stretchable material.

* * * * *